US011223897B2

(12) United States Patent
Chen et al.

(10) Patent No.: US 11,223,897 B2
(45) Date of Patent: Jan. 11, 2022

(54) SOUND PRODUCING DEVICE

(71) Applicant: SUZHOU YICHUAN TECHNOLOGY CO., LTD, Suzhou (CN)

(72) Inventors: Xiaoming Chen, Suzhou (CN); Zhe Wu, Suzhou (CN)

(73) Assignee: Suzhou Yichuan Technology Co., LTD., Suzhou (CN)

( * ) Notice: Subject to any disclaimer, the term of this patent is extended or adjusted under 35 U.S.C. 154(b) by 0 days.

(21) Appl. No.: 16/632,275

(22) PCT Filed: Nov. 23, 2018

(86) PCT No.: PCT/CN2018/117170
§ 371 (c)(1),
(2) Date: Jan. 17, 2020

(87) PCT Pub. No.: WO2019/101161
PCT Pub. Date: May 31, 2019

(65) Prior Publication Data

US 2020/0366984 A1 Nov. 19, 2020

(30) Foreign Application Priority Data

Nov. 24, 2017 (CN) ..... 201711193624.X

(51) Int. Cl.
*H04R 1/28* (2006.01)
*H04R 9/06* (2006.01)
*H04R 17/00* (2006.01)

(52) U.S. Cl.
CPC ..... *H04R 1/2834* (2013.01); *H04R 1/2842* (2013.01); *H04R 9/06* (2013.01); *H04R 17/00* (2013.01); *H04R 2400/11* (2013.01)

(58) Field of Classification Search
CPC . H04R 1/02; H04R 1/28; H04R 17/00; H04R 2400/11; H04R 1/2834; H04R 1/2842; H04R 9/06
(Continued)

(56) References Cited

U.S. PATENT DOCUMENTS 4,147,899 A * 4/1979 Mori ..... H04R 7/08 381/185
5,092,424 A 3/1992 Schreiber
(Continued)

FOREIGN PATENT DOCUMENTS

CN 103747374 A 4/2014
CN 103841477 A 6/2014
(Continued)

OTHER PUBLICATIONS

EP Office Action, dated Aug. 28, 2020.
(Continued)

*Primary Examiner* — Alexander Krzystan
*Assistant Examiner* — Julie X Dang
(74) *Attorney, Agent, or Firm* — Seyfarth Shaw LLP

(57) ABSTRACT

The present invention discloses a sound producing device comprising a housing having a hollow cavity; a first sound producing membrane mounted on the housing, separating the hollow cavity into a first cavity and a second cavity; a main vibration component mounted in the second cavity, separating the second cavity into a main sound producing cavity and a mounting cavity; a first sound outlet hole and a second sound outlet hole in wall portions of the housing; and a driving mechanism in the second cavity. The driving mechanism drives the main vibration component to vibrate, and the vibration of the main vibration component drives the first sound producing membrane to vibrate through the air in the main sound producing cavity; the sound produced by the
(Continued)

main vibration component mixes with the sound produced by the first sound producing membrane.

11 Claims, 2 Drawing Sheets

(58) Field of Classification Search
USPC ..... 381/185, 353, 417, 396, 382
See application file for complete search history.

(56) References Cited

U.S. PATENT DOCUMENTS

| | | | | |
|---|---|---|---|---|
| 2003/0007651 | A1* | 1/2003 | Nakashima | H04R 17/00 381/114 |
| 2006/0152497 | A1* | 7/2006 | Rekimoto | G06F 1/1616 345/173 |
| 2006/0230598 | A1 | 10/2006 | Engbert | |
| 2018/0176692 | A1* | 6/2018 | Doshida | H04R 17/10 |

FOREIGN PATENT DOCUMENTS

| | | | | |
|---|---|---|---|---|
| CN | 205005218 | A | 1/2016 | |
| CN | 105681984 | A | 6/2016 | |
| CN | 106604187 | A | 4/2017 | |
| CN | 107820178 | A | 3/2018 | |
| EP | 3133829 | A1 | 8/2015 | |
| EP | 3133829 | A1 | 2/2017 | |
| EP | 3133829 | A1 * | 2/2017 | H04R 25/604 |
| JP | S5518801 | U | 2/1980 | |
| JP | S5518801 | U1 | 2/1980 | |
| JP | 201141241 | A | 2/2011 | |
| JP | 2017521022 | A | 7/2017 | |

OTHER PUBLICATIONS

European Search Report (dated Jun. 17, 2020).
PCT/CN2018/117170—International Search Report (dated Jan. 30, 2019).
PCT/CN2018/117170—Written Opinion (dated Jan. 30, 2019).
Japanese Office Action (dated Jan. 26, 2021) of corresponding JP Patent Application No. 2020-521474.

* cited by examiner

SOUND PRODUCING DEVICE

TECHNICAL FIELD

The present invention relates to the field of electroacoustic conversion technology, and particularly relates to a sound producing device.

BACKGROUND

A sound producing device is an electroacoustic device for converting audio electric signal into sound signal, without leak of sound, and is widely used in telecommunication terminal devices, such as mobile telephones, landline telephones and hearing aids, for realizing audio (voice, music) replay. The main principle of a sound producing device is utilizing electromagnetic induction effect and piezoelectric effect, while there are also capacitive earphones utilizing the principle of a capacitor. Sound producing devices utilizing the principle of electromagnetic induction mainly include moving-iron type sound producing devices and moving-coil type sound producing devices. The existing moving-iron type sound producing devices are mostly like the sound producing device with a modified housing as disclosed in Chinese patent literature CN103747374A, which comprises a housing, a vibration membrane and an electromagnetic driving mechanism, wherein the vibration membrane is provided in the housing and separates an inner cavity of the housing into a front cavity and a rear cavity, and the electromagnetic driving mechanism is fixed in the rear cavity.

The electromagnetic driving mechanism comprises a transmission rod, an armature, two permanent magnets and a coil; wherein, the armature has one end fixed on an inner surface of a side wall of the housing and the other end connected to the vibration membrane through the transmission rod; the coil is sleeved on the armature and disposed close to the junction between the armature and the housing; the two permanent magnets are respectively disposed on an upper side and a lower side of the end of the armature close to the transmission rod, and are fixed on an inner wall surface of the housing. As for a sound producing device having such a structure, when alternating current is supplied to the coil, the coil generates alternating magnetic field, the armature is magnetized by the alternating magnetic field so as to generate magnetic poles with alternately changing size and direction, and under the action of the fixed magnetic field of the permanent magnets, the armature produces vibration in various frequencies and amplitudes, thereby driving the vibration membrane to produce sound.

However, like other sound producing device in prior art, the sound producing device with the above-mentioned structure only has one sound producing cavity and mainly produces sound waves in medium-and-high frequency bands, with poor capability for producing sound waves in low frequency bands, which eventually causes poor low-frequency characteristics of the sound producing device with this structure.

SUMMARY OF THE INVENTION

Hence, a technical problem to be solved by the present invention is the poor low-frequency characteristics of the sound producing devices in the prior art.

Thus, the present application provides a sound producing device comprising a housing, having a hollow cavity;

a vibration membrane mechanism, including at least one layer of first sound producing membrane that is mounted on the housing and separates the hollow cavity into a first cavity and a second cavity not communicated with each other; and also including a main vibration component that is mounted in the second cavity and has a vibration plate sealedly mounted on the housing; and a driving mechanism, provided in the second cavity, for driving the vibration plate to vibrate reciprocally in a direction that intersects the vibration membrane mechanism;

wherein, the main vibration component separates the second cavity into a main sound producing cavity and a mounting cavity that are arranged side by side with the first cavity and not communicated with each other, the main sound producing cavity is adjacent to the first sound producing membrane; a first sound outlet hole and a second sound outlet hole are respectively opened in wall portions of the housing that correspond to the main sound producing cavity and the first cavity.

Preferably, in the aforementioned sound producing device, at least two layers of the first sound producing membrane are provided, and every two neighboring layers of the first sound producing membrane are spaced apart by a prescribed distance; at least two layers of the first sound producing membrane separate the first cavity into at least two secondary sound producing cavities that are arranged side by side with the main sound producing cavity and not communicated with one another; second sound outlet holes are respectively opened in wall portions of the housing that correspond to the secondary sound producing cavities.

Preferably, the aforementioned sound producing device further comprises an insulation member that matches the first sound producing membrane, wherein the insulation member is mounted on an inner wall of the housing and is provided with a first through-hole communicating the first cavity and the main sound producing cavity, the first sound producing membrane is mounted on the housing by being mounted on the first through-hole.

Preferably, in the aforementioned sound producing device, the main vibration component also comprises a fastening frame, one end of the vibration plate is fastened on the fastening frame, and the other end of the vibration plate is hanging in an inner space of the fastening frame; the main vibration component also comprises a second sound producing membrane which is mounted on the fastening frame and at least sealedly covers the gap between the fastening frame and the vibration plate; the fastening frame is sealedly mounted on the housing; or, at least an end portion of the fastening frame bends toward the first cavity and is sealedly fixed on the first sound producing membrane or the insulation member, with end surfaces of peripheral edges of the fastening frame being sealedly mounted on an inner wall of the housing.

Preferably, in the aforementioned sound producing device, the driving mechanism comprises at least one first permanent magnet mounted on the housing and placed to face a side of the main vibration component; a soft magnet having one end fixed on the housing and the other end fixed on the vibration plate, and placed opposite to the first permanent magnet; and a coil sleeved on the soft magnet.

Further preferably, in the aforementioned sound producing device, the driving mechanism also comprises a second permanent magnet; the second permanent magnet and the first permanent magnet are respectively placed in the main sound producing cavity and in the mounting cavity, the second permanent magnet is placed to be opposite to the first permanent magnet with mutually opposing ends having opposite polarities; the soft magnet and the coil are placed in the mounting cavity; the main vibration component and the soft magnet are placed between the second permanent magnet and the first permanent magnet; and in a vibration direction of the vibration plate, a first gap is preserved between the main vibration component and the second permanent magnet, and a second gap is preserved between the soft magnet and the first permanent magnet.

Further preferably, in the aforementioned sound producing device, when an end portion of the fastening frame bends toward the first cavity and is fixed on the first sound producing membrane or the insulation member, the coil is placed in a space delimited, along an extending direction of the vibration membrane mechanism, between the housing and the bending end portion of the fastening frame.

Preferably, the soft magnet comprises a mounting part mounted on the housing; an extending part which is formed on the mounting part and extends parallel to an extending direction of the vibration plate; and a connection part with one end fixed on the extending part and the other end fixed on the vibration plate, wherein, in a vibration direction of the vibration plate, a third gap is preserved between the extending part and the vibration plate.

Preferably, the connection part is perpendicular to the extending part.

Preferably, the driving mechanism is a piezoelectric vibrator mounted in the mounting cavity in a hanged state, wherein the piezoelectric vibrator is connected to the vibration plate through a connector.

Preferably, the housing comprises a first casing formed by a first bottom with side walls, and a second casing formed by a second bottom with side walls; and an opening of the first casing is buckled upon an opening of the second casing so as to delimit the hollow cavity.

The technical solutions provided by the present invention have the following advantages:

1. The sound producing device provided by the present invention comprises a housing, a vibration membrane mechanism and a driving mechanism. The vibration membrane mechanism comprises a first sound producing membrane and a main vibration component; the housing has a hollow cavity which is separated by the first sound producing membrane into a first cavity and a second cavity not communicated with each other; the second cavity is separated by the main vibration component into a main sound producing cavity and a mounting cavity not communicated with each other; a first sound outlet hole and a second sound outlet hole are respectively opened in wall portions of the housing that correspond to the main sound producing cavity and the first cavity. The driving mechanism drives the main vibration component to vibrate, and the vibration of the main vibration component drives the air in the main sound producing cavity to be compressed or expand, so as to cause air pressure change, and when driven by the changing air pressure, the first sound producing membrane generates vibration; the vibration of the main vibration component and the first sound producing membrane produces two sounds respectively in the main sound producing cavity and in the first cavity, the two sounds from the first sound outlet hole and the second sound outlet hole converge together to produce a mixed sound to be transmitted to the external environment.

The vibration frequency of the first sound producing membrane is consistent with the vibration frequency of the main vibration component, but since the main vibration component drives the first sound producing membrane to vibrate through the air, the vibration of the first sound producing membrane has a certain lag relative to the vibration of the main vibration component, so that a reverberation effect is caused by the sound produced by the first sound producing membrane and the sound produced by the main vibration component, thereby improving the low-frequency characteristics of the sound producing device and enhancing the fullness and depth of the sound produced by the sound producing device.

2. In the sound producing device provided by the present invention, there are at least two layers of the first sound producing membrane separating the first cavity into at least two secondary sound producing cavities each of which is provided with a second sound outlet hole.

In the sound producing device with this structure, the vibration of the main vibration component is gradually transmitted, through the main sound producing cavity, to multiple layers of the first sound producing membrane corresponding to the multiple secondary sound producing cavities sequentially, and the sounds produced by the vibration of the multiple layers of the first sound producing membrane and from the second sound outlet holes converge with the sound produced by the main vibration component, so that the reverberation effect between the sounds produced respectively by the main vibration component and the multiple layers of the first sound producing membrane is enhanced, thereby more effectively improving the low-frequency characteristics of the sound producing device.

3. The sound producing device provided by the present invention further comprises an insulation member provided with a first through-hole, the first sound producing membrane is mounted on the housing by being mounted on the first through-hole. Because the first sound producing membrane is an elastic membrane, it is relatively difficult to directly mount the first sound producing membrane onto the housing during an assembling process of the sound producing device, and by mounting the first sound producing membrane onto the housing through the insulation member, the assembling process is made more convenient.

4. In the sound producing device provided by the present invention, the main vibration component comprises a fastening frame and a second sound producing membrane, wherein one end of the vibration plate is fastened on the fastening frame and the other end of the vibration plate is hanging in an inner space of the fastening frame, the second sound producing membrane is mounted on the fastening frame and sealedly covers the gap between the fastening frame and the vibration plate. The vibration plate has one end serving as a fixed end and the other end as a free end, which not only ensures that the main vibration component separates the second cavity into the main sound producing cavity and the mounting cavity that are independent from each other and not communicated with each other, but also increases the degree of freedom of the vibration plate, so that the vibration amplitude of the vibration plate is increased under the same electromagnetic driving force, thereby improving the loudness of the sound producing device.

5. In the sound producing device provided by the present invention, the driving mechanism comprises at least one first permanent magnet, a second permanent magnet placed to be opposite to each first permanent magnet, a soft magnet and a coil. When alternating current flows in the coil, an alternating magnetic field is generated, and as a result of being magnetized by the alternating magnetic field, the alternating magnetic field is concentrated on the soft magnet, the soft magnet is placed to face the permanent magnets, so that the soft magnet would produce vibration under the action of the fixed magnetic field of the first permanent magnet and the second permanent magnet, thereby driving the main vibration component to produce vibration.

6. In the sound producing device provided by the present invention, an end portion of the fastening frame bends toward the first cavity and is sealedly fixed on the first sound producing membrane or the insulation member; the coil is placed in a space delimited, along an extending direction of the vibration membrane mechanism, between the housing and the bending end portion of the fastening frame. This space has a height larger than that of the rest of the mounting cavity, and mounting of the coil with a relatively large volume within this space may reduce the overall height of the mounting cavity, thereby making the entire sound producing device thinner.

BRIEF DESCRIPTION OF THE DRAWINGS

In order to more clearly describe the technical solutions in the specific embodiments of the present invention or in the prior art, hereinafter, the appended drawings used for describing the specific embodiments or the prior art will be briefly introduced. Apparently, the appended drawings described below are only some embodiments of the present invention, and for a person with ordinary skill in the art, without expenditure of creative labor, other drawings can be derived on the basis of these appended drawings.

REFERENCE SIGNS

1—housing; 11—first casing; 12—second casing;

2—hollow cavity; 21—first cavity; 22—second cavity; 221—main sound producing cavity; 222—mounting cavity;

31—first sound producing membrane; 32—insulation member; 321—first through-hole; 33—main vibration component; 331—vibration plate; 332—fastening frame, 3321—bending portion, 333—second sound producing membrane;

4—driving mechanism, 41—first permanent magnet, 42—second permanent magnet, 43—soft magnet, 431—mounting part, 432—extending part, 433—connection part, 44—coil;

5—first sound outlet hole;

6—second sound outlet hole;

7—sound outlet tube.

DETAILED DESCRIPTION OF EMBODIMENTS

A clear and complete description of the technical solutions of the present invention is given below, in conjunction with the appended drawings. Apparently, the described embodiments are part of, but not all of, the embodiments of the present invention. All the other embodiments, obtained by a person with ordinary skill in the art on the basis of the embodiments in the present invention without expenditure of creative labor, belong to the protection scope of the present invention.

In the description of the present invention, it should be noted that, terms such as "center", "above", "below", "left", "right", "vertical", "horizontal", "inside", "outside" refer to the orientation or positional relationship based on the illustration of the appended drawings, and are only for the purpose of facilitating and simplifying the description of the present invention, rather than indicating or implying that the apparatus or component referred to must have a particular orientation or must be configured or operated in a particular orientation, therefore should not be construed as a limitation towards the present invention. In addition, terms such as "first", "second", "third" are merely for the purpose of description and should not be construed as an indication or implication of relative importance thereof.

In the description of the present invention, it should be noted that, unless specifically defined or restricted otherwise, terms such as "mount", "interconnect", "connect" should be broadly construed, for example, it may be a fixed connection, a detachable connection or an integral connection; it may be a mechanical connection or an electrical connection; it may be either a direct connection or an indirect connection through an intermediate medium, or it may be an internal communication between two units. For a person skilled in the art, the specific meaning of the above terms in the present invention may be understood according to specific situations thereof.

In addition, the technical features involved in different embodiments of the present invention described below may be combined with one another as long as they do not conflict with one another.

Embodiment 1

Figure 1:
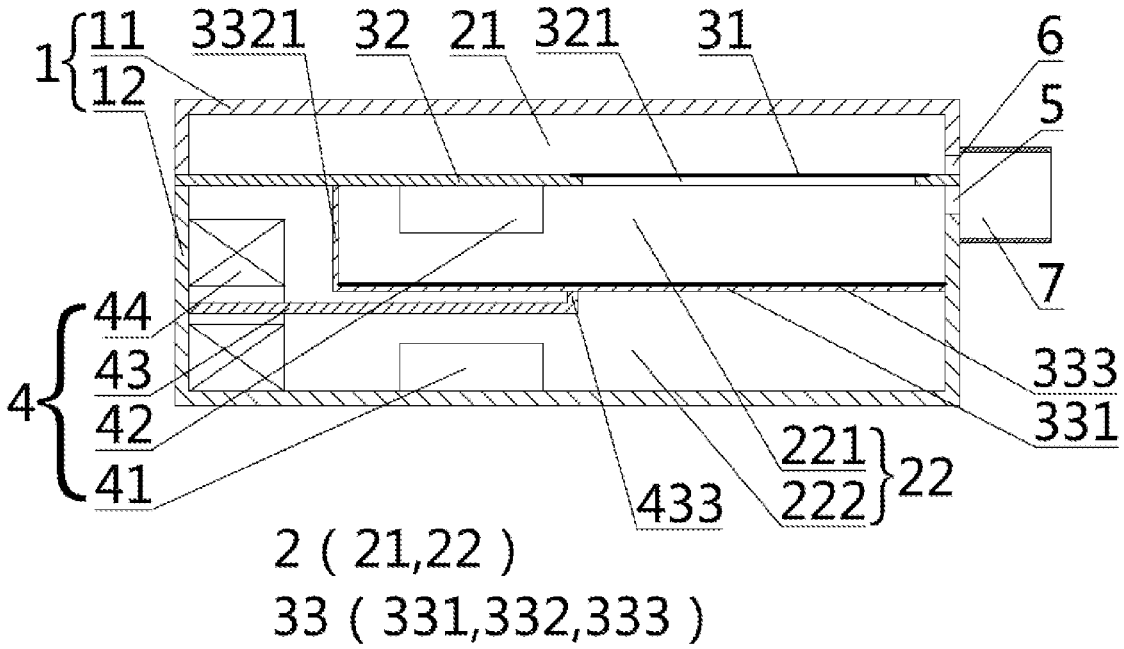
FIG. 1 is a sectional schematic diagram of the sound producing device provided in Embodiment 1 of the present invention.

This embodiment provides a sound producing device, as shown in FIG. 1, the sound producing device comprises a housing 1, a vibration membrane mechanism, a driving mechanism 4, a first sound outlet hole 5 and a second sound outlet hole 6. Wherein, the vibration membrane mechanism comprises a main vibration component 33, a first sound producing membrane 31 and an insulation member 32.

The housing 1 has a hollow cavity 2; the first sound producing membrane 31 is fixed on an inner wall of the housing 1 and separates the hollow cavity 2 into a first cavity 21 and a second cavity 22 not communicated with each other, and it is preferably an elastic membrane; the main vibration component 33 is mounted in the second cavity and separates the second cavity into a main sound producing cavity 221 and a mounting cavity 222 that are arranged side by side with the first cavity 21 and not communicated with each other, the main sound producing cavity 221 is adjacent to the first sound producing membrane 31; correspondingly, the mounting cavity 222 is at a side away from the first sound producing membrane 31; the first sound outlet hole 5 and the second sound outlet hole 6 are respectively opened in wall portions of the housing 1 that correspond to the main sound producing cavity 221 and the first cavity 21.

The driving mechanism 4 is provided in the second cavity, and is for driving the main vibration component 33 to vibrate reciprocally in a direction perpendicular to the extending direction of the vibration membrane mechanism. The driving mechanism 4 drives the main vibration component 33 to vibrate, and the main vibration component 33 in turn drives the air in the main sound producing cavity 221 to be compressed or expand, so as to cause air pressure change, and when driven by the changing air pressure, the first sound producing membrane 31 generates vibration; the vibration of the main vibration component 33 and the first sound producing membrane 31 produces two sounds respectively in the main sound producing cavity 221 and in the first cavity 21, the two sounds respectively from the first sound outlet hole 5 and the second sound outlet hole 6 converge together to produce a mixed sound to be transmitted to the external environment. The vibration frequency of the first sound producing membrane 31 is consistent with the vibration frequency of the main vibration component 33, but since the main vibration component 33 drives the first sound producing membrane 31 to vibrate through the air, which causes the vibration of the first sound producing membrane 31 to have a certain lag relative to the vibration of the main vibration component 33, a reverberation effect is caused by the sound produced by the first sound producing membrane 31 and the sound produced by the main vibration component 33, thereby improving the low-frequency characteristics of the sound producing device and enhancing the fullness and depth of the sound produced by the sound producing device.

As shown in FIG. 1, the vibration membrane mechanism also comprises an insulation member 32 that matches the first sound producing membrane 31, the insulation member has a plate shape, with the outer edges of the insulation member 32 sealedly mounted on an inner wall of the housing 1, a first through-hole 321 communicating the first cavity 21 and the main sound producing cavity 221 is opened in the insulation member 32, and the first sound producing membrane 31 is fixed on the inner wall of the housing 1 by its edges being sealedly mounted on the first through-hole 321, the main vibration component 33 transmits vibration to the first sound producing membrane 31 through the air within the main sound producing cavity 221.

The first sound producing membrane 31 is an elastic membrane, so it is relatively difficult to directly sealedly mount the first sound producing membrane 31 onto the inner wall of the housing 1 during an assembling process of the sound producing device, and sealedly mounting of the first sound producing membrane 31 onto the housing through transition by the insulation member 32 lowers the difficulty level of the assembling, so as to increase the production efficiency.

Figure 2:
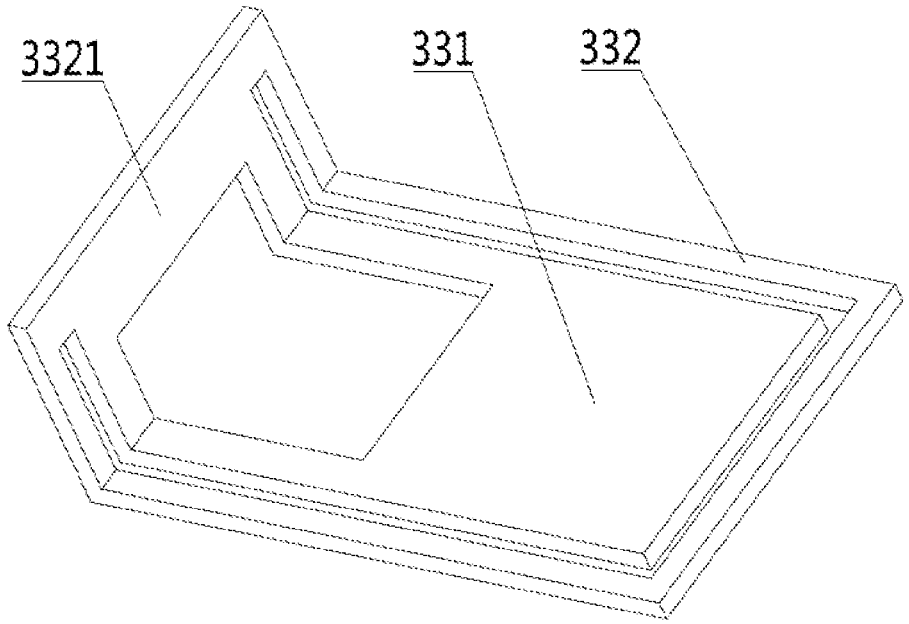
FIG. 2 is a structural schematic diagram of the main vibration component of the sound producing device in FIG. 1.

As shown in FIG. 1 and FIG. 2, the main vibration component 33 comprises a vibration plate 331, a fastening frame 332 and a second sound producing membrane 333.

In the main vibration component 33, an end portion of the fastening frame 332 bends toward the first cavity 21 and is sealedly fixed on the insulation member 32, so as to form a bending portion 3321, the bending portion 3321 forms an angle of 90 degree with the body of the fastening frame 332, and the end surfaces of peripheral edges of the rest of the fastening frame are sealedly mounted on the inner wall of the housing 1, so that, as viewed from a lateral side, the entire fastening frame 332 has an L-shape.

One end of the vibration plate 331 is fastened on the end of the fastening frame 332 having the bending portion 3321, so as to serve as a fixed end, and the other end of the vibration plate 331 is hanging in an inner space of the fastening frame 332, so as to serve as a free end, the vibration plate 331 is also provided with a rectangular through-hole adjacent to its junction with the fastening frame 332; the second sound producing membrane 333, which is preferably an elastic membrane, fits on surfaces of the fastening frame 332 and the vibration plate 331 at a side within the main sound producing cavity 221, and sealedly covers the gap between the fastening frame 332 and the vibration plate 331 as well as the rectangular through-hole in the vibration plate 331.

The sealedly covering second sound producing membrane 333 ensures that the main vibration component 33 separates the second cavity 22 into the main sound producing cavity 221 and the mounting cavity 222 that are independent from each other and not communicated with each other, and thus ensures the sound-producing quality of these two cavities; meanwhile, the structure of the fastening frame 332 and the vibration plate 331 also increases the degree of freedom of the vibration plate 331, so that the vibration plate 331 can reach a larger vibration amplitude under the same electromagnetic driving force.

As shown in FIG. 1, the driving mechanism 4 comprises a first permanent magnet 41, a second permanent magnet 42, a soft magnet 43 and a coil 44.

Along an extending direction of the insulation member 32, an evading space is formed between a side wall of the housing 1 and the bending portion 3321 of the fastening frame 332, like the left area of the second cavity 22 shown in FIG. 1, the coil 44 is fixed on an inner wall portion of the housing 1 that corresponds to the mounting cavity 222 and is placed within this evading space, and because this evading space has a height larger than that of the rest of the mounting cavity 222, by mounting the coil 44 with a relatively large volume within this evading space, the overall height of the mounting cavity 222 can be reduced, thereby making the entire sound producing device thinner.

The soft magnet 43, which passes through an interior of the coil 44, has one end fixed on the inner wall of the housing 1 and the other end fixed on a surface of the vibration plate 331 at a side facing the mounting cavity 222.

The first permanent magnet 41 is fixed on an inner wall portion of the housing 1 that corresponds to the mounting cavity 222, the second permanent magnet 42 is arranged in the main sound producing cavity 221 and is mounted on a surface of the insulation member 32 at a side facing the main sound producing cavity 221; the first permanent magnet 41 and the second permanent magnet 42 are placed to be directly opposite to each other with mutually opposing faces having opposite polarities, the other end of the soft magnet 43 are placed between the first permanent magnet 41 and the second permanent magnet 42; and in a vibration direction of the main vibration component 33, a second gap is preserved between the first permanent magnet 41 and the soft magnet 43, and a first gap is preserved between the second permanent magnet 42 and the first sound producing membrane 31, the first and second gaps can preserve enough space for the vibration of the main vibration component 33, so that the first permanent magnet 41 and the second permanent magnet 42 would not interfere with the vibration of the main vibration component 33.

When external audio electric signal is applied to the coil 44, i.e., alternating current is supplied to the coil 44, the coil 44 would generate an alternating magnetic field, and as a result of being magnetized by this alternating magnetic field, the alternating magnetic field generated by the coil is concentrated on the soft magnet, and the polarities on both ends of the soft magnet 43 would change alternately; since the common fixed magnetic field of the first permanent magnet 41 and the second permanent magnet 42 are constant, the end of the soft magnet 43 placed between the first permanent magnet 41 and the second permanent magnet 42 would be affected by a force with continuously changing direction and size acted by the fixed magnetic field, so as to produce vibration, thus, in turn drives the vibration plate of the main vibration component 33 to vibrate.

Figure 3:
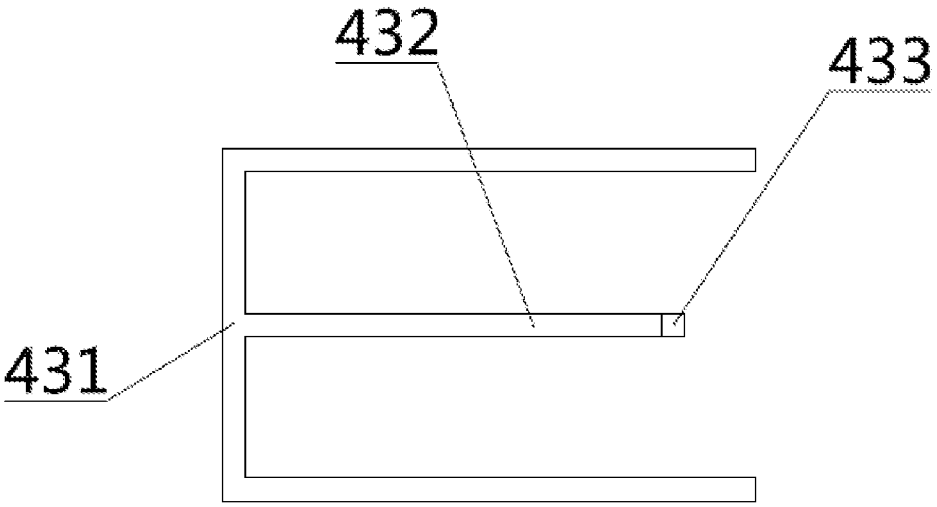
FIG. 3 is a top view of the soft magnet of the sound producing device in FIG. 1.

As shown in FIG. 1 and FIG. 3, the soft magnet 43 comprises a mounting part 431, an extending part 432 and a connection part 433, wherein the mounting part 431 has a U-shape and is fixed on the inner wall of the housing 1, the strip-shaped extending part 432 is formed on the mounting part 431, the extending part 432 extends outward in a direction parallel to the extending direction of the vibration plate 331, and the connection part 433 is formed on the outermost end of the extending part 432, the connection part 433 is preferably a column-shaped structure perpendicular to the extending part 432, with the other end of the connection part 433 being connected to the vibration plate 331, so the extending part 432 is fixed on the vibration plate 331 through the connection part 433.

In a vibration direction of the vibration plate 331, the arrangement of the connection part 433 ensures a third gap is preserved between the extending part 432 and the vibration plate 331, so that the extending part 432 is prevented from interfering with the vibration of the vibration plate 331.

As shown in FIG. 1, the housing 1 comprises a first casing 11 and a second casing 12. The first casing 11 is constructed by a first bottom with side walls; the second casing 12 is constructed by a second bottom with side walls. An opening of the first casing 11 is buckled upon an opening of the second casing 12 so as to delimit the hollow cavity 2 of the entire housing 1.

The first casing 11, the insulation member 32 and the first sound producing membrane 31 together delimit the first cavity 21; the second casing 12, the insulation member 32 and the first sound producing membrane 31 together delimit the second cavity 22; the main vibration component 33, the insulation member 32, the first sound producing membrane 31 and part of the inner wall of the second casing 12 together delimit the main sound producing cavity 221; the main vibration component 33 and the rest of the inner wall of the second casing 12 together delimit the mounting cavity 222.

The edges of the insulation member 32 are sealedly mounted on an outer end face of the opening of the first casing 11, or on an outer end face of the opening of the second casing 12; the rest of the side walls of the fastening frame 332 are sealedly fixed on the inner wall of the second casing 12; the mounting part 431, the coil 44 and the first permanent magnet 41 are all fixed on the inner wall of the second casing 12.

The second sound outlet hole 6 is opened in a wall of the first casing 11; the first sound outlet hole 5 is opened in the part of the wall of the second casing 12 that corresponds to the main sound producing cavity 221. The first sound outlet hole 5 and the second sound outlet hole 6 is arranged on the same side of the housing and close to each other, a sound outlet tube 7 is also mounted on the wall of the housing 1, the first sound outlet hole 5 and the second sound outlet hole 6 are both located inside the sound outlet tube 7, the sound outlet tube 7 can more effectively converge the sounds from the first sound outlet hole 5 and the second sound outlet hole 6.

The connection manner of the aforementioned sealed mounting, fixing, mounting, etc. are by means of welding, gluing, etc.

Besides, it needs to be noted that, as shown in FIG. 1, the vibration membrane mechanism is arranged in a horizontal direction in FIG. 1, and the driving mechanism 4 drives the main vibration component 33 to vibrate reciprocally in a direction perpendicular to the extending direction of the vibration membrane mechanism. This means the vibration plate of the main vibration component 33 vibrates up and down vertically with its fixed end serving as a vibration fulcrum, and because the vibration fulcrum is relatively fixed, a curved moving trajectory is formed in the process of the vibration plate vibrating up and down, so the driving force acted by the driving mechanism 4 on the vibration plate has component forces both in the vertical direction and in the horizontal direction, but the component force in the vertical direction is far larger than the component force in the horizontal direction. That is to say, the driving mechanism 4 drives the main vibration component 33 to vibrate reciprocally in a direction which is actually intersecting the vibration membrane mechanism.

Embodiment 2

This embodiment provides a sound producing device, and in comparison with the structure of the sound producing device provided in Embodiment 1, the only difference is that the first sound producing membrane 31 include two, three, four or more layers, wherein every two neighboring layers of the first sound producing membrane 31 are arranged in parallel to each other and spaced apart by a prescribed distance.

Each layer of the first sound producing membrane 31 is mounted on the housing 1 via an insulation member 32, wherein a first through-hole 321 is opened in the insulation member 32, the layer of the first sound producing membrane 31 is sealedly mounted on the first through-hole 321, and the outer edges of the insulation member 32 is sealedly mounted on an inner wall of the first casing 11, or on an outer end face of the opening of the first casing 11, or on an outer end face of the opening of the second casing 12.

The innermost layer of the first sound producing membrane 31 and its corresponding insulation member 32 together with the main vibration component 33 and part of the inner wall of the second casing 12 delimit the main sound producing cavity 221; every two neighboring layers of the first sound producing membrane 31 and their corresponding insulation members 32 together with the portion of the inner wall of the first casing 11 interposed between the two insulation members 32 delimit one secondary sound producing cavity; the outermost layer of the first sound producing membrane 31 and its corresponding insulation member 32 together with part of the inner wall of the first casing 11 delimit a secondary sound producing cavity; second sound outlet holes 6 are respectively opened in wall portions of the first casing 11 that correspond to each of the secondary sound producing cavities. That is to say, by providing n layers of the first sound producing membrane 31 and corresponding insulation members 32, the first cavity 21 is divided into n+1 secondary sound producing cavities, wherein n is a natural number larger than or equal to 1.

The vibration of the main vibration component 33 is transmitted sequentially, through the main sound producing cavity 221 and the multiple secondary sound producing cavities, to the layers of the first sound producing membrane 31 corresponding to the respective secondary sound producing cavities, and the sounds produced by the vibration of the multiple layers of the first sound producing membrane 31 all converge with the sound produced by the main vibration component 33 via the respective second sound outlet holes 6, so that the reverberation effect between the sound produced by the main vibration component 33 and the sounds produced by the layers of the first sound producing membrane 31 is enhanced, thereby more effectively improving the low-frequency characteristics of the sound producing device.

Embodiment 3

This embodiment provides a sound producing device, and in comparison with the structure of the sound producing device provided in Embodiment 1 or 2, the only difference is that the housing is jointly composed of multiple casings including a first casing 11, a second casing 12, a third casing and so on, wherein the intermediate casing(s) has/have openings on both ends, and the particular number of the casings depends on the demands of production processing.

Embodiment 4

This embodiment provides a sound producing device, and in comparison with the structure of the sound producing device provided in any of Embodiments 1 to 3, the only difference is that the bending portion 3321 of the fastening frame 332 may be directly connected on the first sound producing membrane 31; furthermore, the angle formed between the bending portion 3321 and the body of the fastening frame 332 may be an arbitrary angle, such as 20 degree, 30 degree, etc.

As a variant implementation way, there may be no insulation member 32 provided, and the sound producing membrane 31 is directly sealedly mounted on the inner wall of the housing 1.

Embodiment 5

This embodiment provides a sound producing device, and in comparison with the structure of the sound producing device provided in any of Embodiments 1 to 4, the only difference is that the connection part 433 may form an arbitrary angle, such as 20 degree, 30 degree, etc., with the extending part 432, as long as the third gap is guaranteed to be reserved between the extending part 432 and the main vibration component 33.

Figure 4:
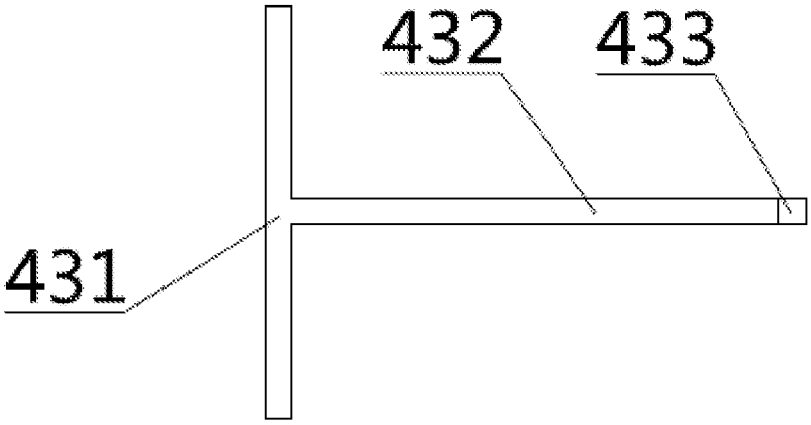
FIG. 4 is a top view of the soft magnet provided in Embodiment 5 of the present invention.

As a further variant, as shown in FIG. 4, the mounting part 431 has a single-strip structure.

As an alternative implementation way, the coil 44 may not be placed in the evading space between the bending portion 3321 and the side wall of the housing 1, but instead may be placed in another location within the mounting cavity 222, as long as the vibration plate 331 can be driven to vibrate reciprocally under the action of the alternating magnetic field generated by the coil 44 and the fixed magnetic field of the two permanent magnets.

As a further alternative implementation way, the number of the second permanent magnets 42 may be two, three, etc., and the number of the first permanent magnets 41 is corresponding thereto; or, only the first permanent magnet(s) 41 or only the second permanent magnet(s) 42 may be provided; furthermore, the number of the first permanent magnet(s) 41 or the second permanent magnet(s) 42 may be one, two, three, etc.

As a further alternative implementation way, the soft magnet 43 and the coil 44 may also be arranged in the main sound producing cavity 221. Or, the driving mechanism 4 does not provide a soft magnet 43 and only provides the coil 44 and a permanent magnet, and when the permanent magnet is fixed on the vibration plate 331 and placed opposite to the coil 44, it can also drive the vibration plate 331 to vibrate reciprocally.

Embodiment 6

This embodiment provides a sound producing device, and in comparison with the structure of the sound producing device provided in any of Embodiments 1 to 5, the only difference is that the driving mechanism 4 is different, wherein the driving mechanism 4 in this embodiment comprises a piezoelectric vibrator and a connector, the piezoelectric vibrator is connected to an inner wall of the mounting cavity 222 in a hanged state, the piezoelectric vibrator and the main vibration component 33 are connected together through the connector. When alternating current is supplied to the piezoelectric vibrator, the piezoelectric vibrator itself would vibrate reciprocally, so as to drive the main vibration component 33 to vibrate through the connector.

Embodiment 7

This embodiment provides a sound producing device, and in comparison with the structure of the sound producing device provided in any of Embodiments 1 to 6, the only difference is that at least one side wall of the fastening frame 332 bends toward the mounting cavity 222 and is fixed on an inner wall of the housing 1; or, the fastening frame 332 does not have a bending portion 3321, and all of its side walls are directly sealedly fixed on the inner wall of the housing 1.

As a further alternative implementation way, the main vibration component 33 may not have a fastening frame 332, one end of the vibration plate 331 is fixed on the inner wall of the housing 1 to serve as a fixed end, and the other end of the vibration plate 331 is hanging in the second cavity 22 to serve as a free end, with the second sound producing membrane 333 sealedly covering the gap between the vibration plate 331 and the inner wall of the housing 1; or, there may be no second sound producing membrane 333 provided, and the edges of the vibration plate 331 are directly sealedly fixed on the inner wall of the housing 1.

Apparently, the aforementioned embodiments are merely examples illustrated for giving a clear description, rather than limiting the implementation ways thereof. For a person with ordinary skill in the art, various changes and modifications in other different forms can be made on the basis of the aforementioned description. It is unnecessary and impossible to exhaustively list all the implementation ways herein. However, any obvious changes or modifications derived from the aforementioned description are intended to be embraced within the protection scope of the present invention.

The invention claimed is:

1. A sound producing device, comprising a housing, having a hollow cavity;

a vibration membrane mechanism, including at least one layer of first sound producing membrane that is mounted on the housing and separates the hollow cavity into a first cavity and a second cavity separate from each other; and also including a main vibration component mounted in the second cavity and having a vibration plate sealedly mounted on the housing; and a driving mechanism, provided in the second cavity, for driving the vibration plate to vibrate reciprocally in a direction that intersects the vibration membrane mechanism;

wherein, the main vibration component separates the second cavity into a main sound producing cavity and a mounting cavity that are arranged side by side with the first cavity and separate from each other, the main sound producing cavity is adjacent to the first sound producing membrane; a first sound outlet hole and a second sound outlet hole are respectively opened in wall portions of the housing that correspond to the main sound producing cavity and the first cavity, and wherein the driving mechanism is configured to drive the main vibration component to vibrate, and the main vibration component is configured to drive the air in the main sound producing cavity to compress or expand, to cause an air pressure change that drives the first sound producing membrane to generate vibration.

2. The sound producing device according to claim 1, wherein, at least two layers of the first sound producing membrane are provided, and every two neighboring layers of the first sound producing membrane are spaced apart by a prescribed distance;

at least two layers of the first sound producing membrane separate the first cavity into at least two secondary sound producing cavities that are arranged side by side with the main sound producing cavity and separate from one another; second sound outlet holes are respectively opened in wall portions of the housing that correspond to the secondary sound producing cavities.

3. The sound producing device according to claim 1, further comprising an insulation member that matches the first sound producing membrane, wherein the insulation member is mounted on an inner wall of the housing and is provided with a first through-hole communicating the first cavity and the main sound producing cavity, the first sound producing membrane is mounted on the housing by being mounted on the first through-hole.

4. The sound producing device according to claim 3, wherein, the main vibration component also comprises a fastening frame, one end of the vibration plate is fastened on the fastening frame, and the other end of the vibration plate is hanging in an inner space of the fastening frame; the main vibration component also comprises a second sound producing membrane which is mounted on the fastening frame and at least sealedly covers the gap between the fastening frame and the vibration plate; and the fastening frame is sealedly mounted on the housing; or, at least an end portion of the fastening frame bends toward the first cavity and is sealedly fixed on the first sound producing membrane or the insulation member, with end surfaces of peripheral edges of the fastening frame being sealedly mounted on an inner wall of the housing.

5. The sound producing device according to claim 1, wherein, the driving mechanism comprises at least one first permanent magnet mounted on the housing and placed to face a side of the main vibration component;

a soft magnet having one end fixed on the housing and the other end fixed on the vibration plate, and placed opposite to the first permanent magnet; and a coil sleeved on the soft magnet.

6. The sound producing device according to claim 5, wherein, the driving mechanism also comprises a second permanent magnet;

the second permanent magnet and the first permanent magnet are respectively placed in the main sound producing cavity and in the mounting cavity, the second permanent magnet is placed to be opposite to the first permanent magnet with mutually opposing ends having opposite polarities; and the soft magnet and the coil are placed in the mounting cavity; the main vibration component and the soft magnet are placed between the second permanent magnet and the first permanent magnet; and in a vibration direction of the vibration plate, a first gap is preserved between the main vibration component and the second permanent magnet, and a second gap is preserved between the soft magnet and the first permanent magnet.

7. The sound producing device according to claim 6, wherein, when an end portion of the fastening frame bends toward the first cavity and is fixed on the first sound producing membrane or the insulation member, the coil is placed in a space delimited, along an extending direction of the vibration membrane mechanism, between the housing and the bending end portion of the fastening frame.

8. The sound producing device according to claim 5, wherein, the soft magnet comprises a mounting part mounted on the housing; an extending part which is formed on the mounting part and extends parallel to an extending direction of the vibration plate; and a connection part with one end fixed on the extending part and the other end fixed on the vibration plate, wherein, in a vibration direction of the vibration plate, a third gap is preserved between the extending part and the vibration plate.

9. The sound producing device according to claim 8, wherein, the connection part is perpendicular to the extending part.

10. The sound producing device according to claim 1, wherein, the driving mechanism is a piezoelectric vibrator mounted in the mounting cavity in a hanged state, wherein the piezoelectric vibrator is connected to the vibration plate through a connector.

11. The sound producing device according to claim 1, wherein, the housing comprises a first casing formed by a first bottom with side walls, and a second casing formed by a second bottom with side walls; and an opening of the first casing is buckled upon an opening of the second casing so as to delimit the hollow cavity.

* * * * *